US005435622A

United States Patent [19]

Fay et al.

[11] Patent Number: 5,435,622

[45] Date of Patent: Jul. 25, 1995

[54] SWIVEL RECLINER/ROCKER CHAIR HAVING PRELOADED BASE ASSEMBLY

[75] Inventors: Judy E. Fay, Newport; Jonathan R. Saul, LaSalle; Larry P. LaPointe, Temperance, all of Mich.

[73] Assignee: La-Z-Boy Chair Company, Monroe, Mich.

[21] Appl. No.: 238,407

[22] Filed: May 5, 1994

[51] Int. Cl.[6] ..... A47C 3/02

[52] U.S. Cl. ..... 297/267; 297/344.21; 297/DIG. 7; 297/272; 297/265

[58] Field of Search ..... 297/261, 264, 265, 266, 297/267, 270, 271, 272, 258, 344.21, DIG. 7

[56] References Cited

U.S. PATENT DOCUMENTS

| | | |
|---|---|---|
| 169,314 | 10/1875 | Travis . |
| 400,564 | 4/1889 | Gunn . |
| 448,240 | 3/1891 | Kade . |
| 509,663 | 11/1893 | Holloway . |
| 540,877 | 6/1895 | Ryan . |
| 1,983,206 | 12/1934 | Witzel . |
| 2,528,331 | 10/1950 | Bell . |
| 2,772,723 | 12/1956 | Tunnell . |
| 2,813,574 | 11/1957 | Hawkins . |
| 2,871,916 | 2/1959 | Fox . |
| 3,053,570 | 9/1962 | Fox . |
| 3,141,700 | 7/1964 | Fletcher . |
| 3,190,693 | 6/1965 | Underdown . |
| 3,300,244 | 1/1967 | Hughes . |
| 3,368,843 | 2/1968 | Caldemeyer . |
| 3,415,531 | 12/1968 | Kiel . |
| 3,547,393 | 12/1970 | Gordin . |
| 3,608,958 | 9/1971 | Knabusch et al. . |
| 3,840,205 | 10/1974 | Faull . |
| 3,881,713 | 5/1975 | Joyce . |
| 3,966,251 | 6/1976 | Belisle . |
| 4,736,984 | 4/1988 | Tacker . |
| 4,758,044 | 7/1988 | Rogers, Jr. . |
| 4,807,926 | 2/1989 | Brunn . |
| 4,810,032 | 3/1989 | Gibson . |
| 5,171,000 | 12/1992 | LaPointe et al. . |

FOREIGN PATENT DOCUMENTS

| | | |
|---|---|---|
| 2154867 | 9/1985 | United Kingdom . |

*Primary Examiner*—Kenneth J. Dorner
*Assistant Examiner*—Anthony Barfield
*Attorney, Agent, or Firm*—Harness, Dickey & Pierce

[57] ABSTRACT

A swivel recliner/rocker chair which even more effectively resists unwanted rocking of the swivel base member thereof when the chair is rocked forwardly of the swivel base member, and which further is limited in its rearward reclining or rocking motion to a predetermined degree so as to thereby limit rocking of the swivel base member that might occur if the chair is reclined or rocked rearwardly of the swivel base member to an excessive degree. The chair includes a pair of rocker blocks having a flat section formed thereon and a pair of spring assemblies having upper and lower bracket members. The upper bracket members are secured to the rocker blocks and the lower bracket members are secured to side members of a base assembly such that the rocker blocks rock on the side members during reclining or rocking movement of the chair. The upper and lower bracket members are further secured to their respective rocker blocks and side members such that each spring assembly exerts a slight tensioning force to urge the seating section of the chair into a slightly reclined position even when there is no occupant seated in the chair. This substantially eliminates any possibility of forward rocking motion of the swivel base member when the chair is rocked forwardly. The flat portions of each rocker block further serve to limit the maximum reclining and rearward rocking movement of the seating section to thereby avoid any undesirable rocking of the swivel base member as the seating section is reclined or rocked in a rearward direction.

9 Claims, 4 Drawing Sheets

FIG 4
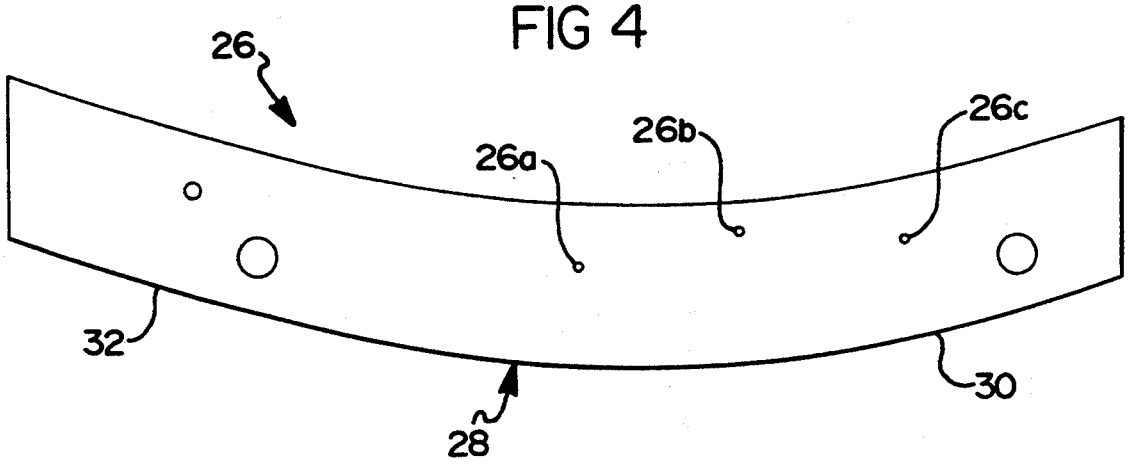
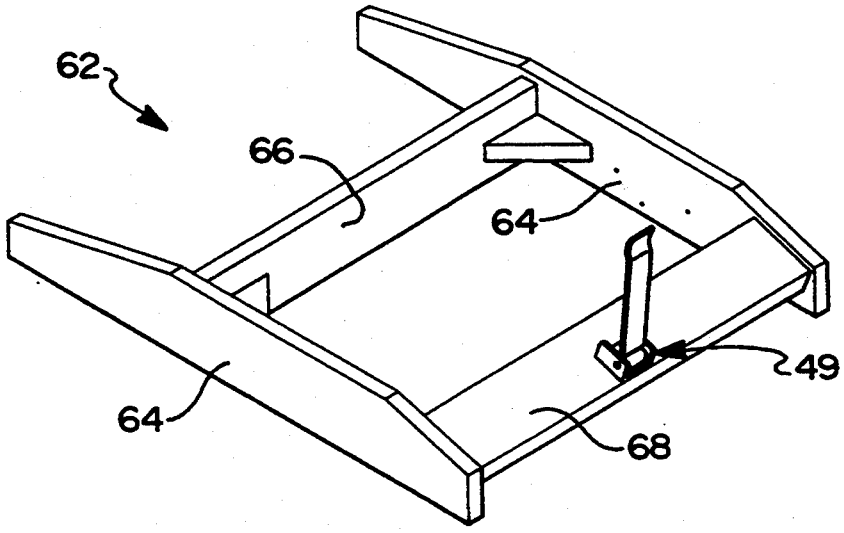
FIG 6

SWIVEL RECLINER/ROCKER CHAIR HAVING PRELOADED BASE ASSEMBLY

BACKGROUND OF THE INVENTION

1. Technical Field

This invention relates to recliner chairs, and more particularly to a swivel recliner/rocker chair which is biased slightly into a reclined position when the chair is not occupied by an individual, and which also includes means for limiting reclining and rearward rocking movement of the chair to a predetermined degree.

2. Discussion

Swivel recliner/rocker chairs are used in a wide variety of environments, and particularly in homes, to provide the comfort of a recliner/rocker with the added convenience of being able to swivel about a support platform to more easily reach nearby tables, magazine racks, home office or entertainment equipment, etc. With many prior developed swivel recliner chairs, the chair must be positioned forward off-center of its swivel base member which supports the chair for swiveling movement. This is so that the center of gravity of the chair, when the chair is urged by an individual into a maximum reclined position, is not so far off-center of the swivel base member so as to cause rearward rocking of the swivel base member itself, and thus undesirable rocking of the entire chair. If the chair itself was mounted such that its center of gravity, when unoccupied, is over the geometric center of the swivel base member, then the recliner chair would be prone to "rock" rearwardly when an individual urges it into its fully reclined position or rocks rearwardly while rocking in the chair. This is because the center of gravity of the chair, as well as the occupant, changes (i.e., moves rearwardly relative to the swivel base member) when the occupant urges the chair into the reclined position.

When a swivel recliner chair such as described above is positioned forward off-center of its swivel base member to eliminate the possibility of undesirable rearward rocking of the swivel base member, the chair sometimes has the undesirable tendency to rock forward when the occupant releases the recliner chair from a reclined position and the chair moves into a substantially upright position, or when the occupant rocks forward and stands up from the chair. This is because the center of gravity of the chair, when in its upright position, is significantly off-center towards the front of the swivel base member of the chair. Thus, the rapid movement of the chair from a fully reclined position to a fully upright position can sometimes cause a "rocking" action of the swivel base member. This rocking action can be exacerbated if the occupant quickly gets up out of the chair as the chair reaches its fully upright position.

Another drawback with some previously designed swivel recliner chairs is the lack of any means by which the reclining motion of the chair can be positively limited to a predetermined degree. Heretofore developed recliner/rocker chairs typically rely on the tension force provided by a pair of coil spring assemblies, which also enable the rocking action of the chair, to resist allowing the chair to be reclined too far. While somewhat effective, such recliner/rocker chairs still often can be rocked rearwardly beyond a point which places the center of gravity of the chair too far rearwardly on its stationary base member, thus causing an undesirable rocking action of the base member itself, and thus causing a somewhat unstable feeling of operation of the chair.

Accordingly, it is a principal object of the present invention to provide a swivel recliner/rocker chair having means for biasing the chair into a slightly reclined position, even when no seat occupant is in the chair, to thereby avoid the undesirable rocking of a swivel base member of the chair when the chair is rocked forwardly, such as when an individual quickly gets up out of the chair at the end of a forward rocking motion.

It is yet another object of the present invention to provide a swivel recliner/rocker chair having means for more positively limiting the maximum rearward rocking motion of the chair when the occupant of the chair rocks back in the chair.

It is still another object of the present invention to provide a swivel recliner/rocker chair which is biased into a slightly reclined position even when the chair is not occupied by an individual, and without the need for additional components in the rocker spring mechanism of the chair beyond that which would typically be included in such a mechanism.

It is still another object of the present invention to provide a swivel recliner/rocker chair in which the maximum reclining movement of the chair is positively limited to a predetermined degree without the need for additional component parts in the rocking mechanism of the chair beyond that typically required for such a mechanism.

SUMMARY OF THE INVENTION

The above and other objects are provided by a swivel recliner/rocker chair in accordance with a preferred embodiments of the present invention. In one preferred embodiment, the chair includes a seating unit having a pair of side walls, a seat member and a seat back member. A pair of rocker blocks are secured to insides of each of the side walls. Each of the rocker blocks include a support surface having a curved portion and a generally flat or planar portion. The seating section is supported for rocking movement by a pair of spring assemblies. Each of the spring assemblies includes an upper bracket member, at least one spring, and a lower bracket member. Each of the upper and lower bracket members of each spring assembly include a plurality of apertures, with the upper bracket member of each spring assembly being secured at a predetermined position on a respective one of the rocker blocks. The lower bracket member of each spring assembly is similarly secured to a base assembly such that the support surfaces of the rocker blocks rest on portions of the base assembly.

The lower bracket members are secured to portions of the base assembly at a position that causes each spring assembly to exert a slight tensioning force between rearward portions of the upper and lower bracket members of each spring assembly. This tensioning force causes the seating section to be urged into a slightly reclined position even when the seat is unoccupied. The chair is supported for swiveling movement by a swivel plate assembly which is fixedly secured to the base assembly and also to a swivel base member.

An additional important advantage provided by the rocker blocks of the swivel recliner/rocker chair of the present invention is that the generally flat portions of each rocker block serve to positively limit the rearward rocking motion of the chair as an individual seated within the chair rocks backwards. This serves to prevent undesirable rocking of the swivel base member of the chair which might otherwise occur if the seat occupant rocked or reclined the chair beyond a predetermined point of rearward travel.

In the preferred embodiments the chair of the present invention also incorporates a front cover which is secured between the side walls of the seating unit. A ratchet member is secured to the front cover and engages with a pawl assembly operably coupled to the base assembly of the chair. The pawl assembly and ratchet member operate to hold the chair in a desired, reclined position when the chair is urged into a reclined position by the seat occupant.

The swivel recliner/rocker chair of the present invention thus provides for limiting the rearward rocking motion of the chair, as well as helping to prevent undesirable rocking of the swivel base member of the chair, without the need for incorporating special component parts to accomplish these functions. Accordingly, the chair can be manufactured more simply, easily and inexpensively since no additional components beyond those typically required for a swivel recliner/rocker chair are needed to accomplish the above-mentioned objectives.

BRIEF DESCRIPTION OF THE DRAWINGS

The various advantages of the present invention will become apparent to one skilled in the art by reading the following specification and subjoined claims and by referencing the following drawings in which:

FIG. 4 is a side view of the rocker block shown in FIG. 2 showing more clearly the support surface thereof which includes a curved portion and a generally flat portion;

FIG. 6 is a perspective view of an alternative preferred base assembly of the present invention which is particularly well adapted for use with recliner/rocker chairs which do not swivel.

DETAILED DESCRIPTION OF THE PREFERRED EMBODIMENT

Figure 1:
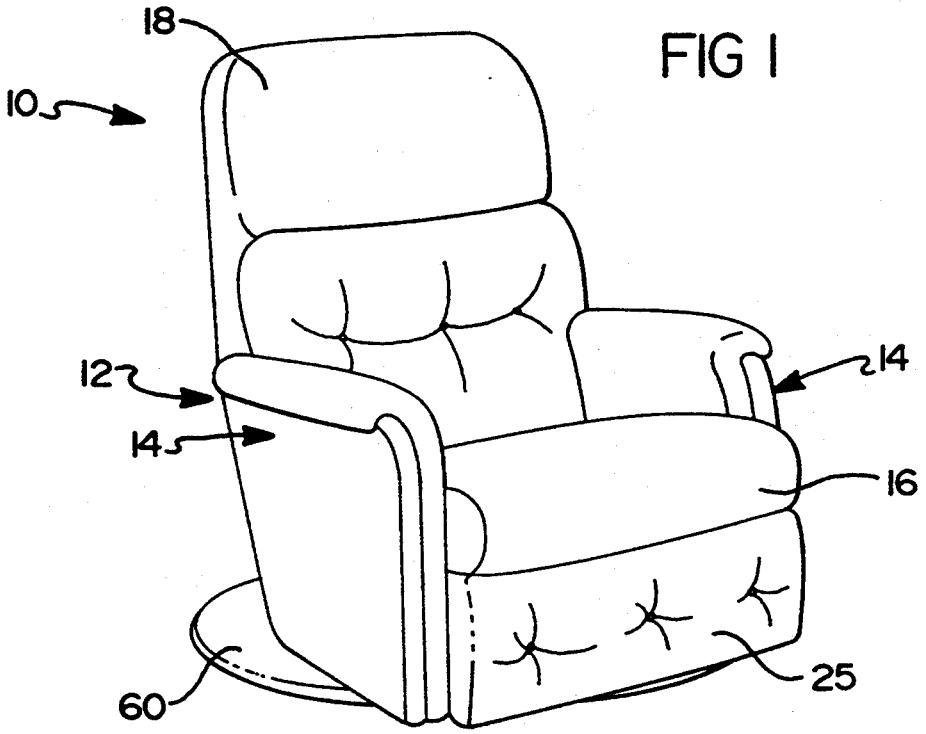
FIG. 1 is a perspective view of a swivel recliner/-rocker chair in accordance with a preferred embodiment of the present invention.
Figure 2:
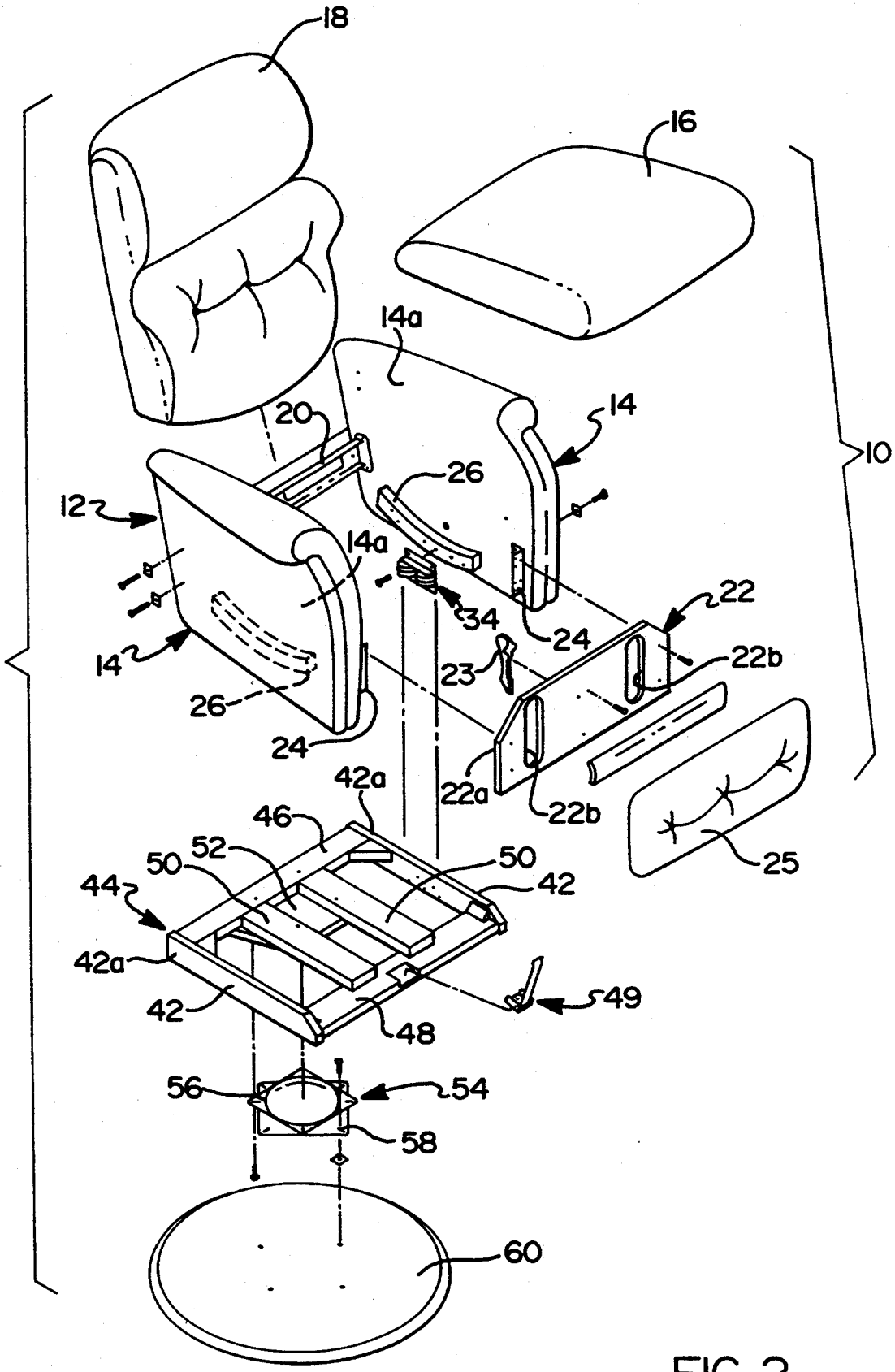
FIG. 2 is an exploded perspective view of the chair of FIG. 1.

Referring to FIGS. 1 and 2, a swivel recliner/rocker chair 10 in accordance with a preferred embodiment of the present invention is shown. The chair 10 generally includes a seating section 12 having a pair of side walls 14 disposed parallel to one another, a seat member 16 and a seat back 18. With specific reference to FIG. 2, the side walls 14 are coupled via a rear support rail 20 and a front support member 22. The front support member 22 is operably secured to the side walls 14 via a pair of brackets 24 secured to inner wall portions **14*a* of the side walls 14. A leg rest member 25 is positioned over the front support member 22 and is extendable outwardly from the front support member by a pantograph linkage assembly (not shown) of the chair 10, which includes members that project through openings 22*b* in the member 22 to extend and retract the leg rest member 25. Further secured to an inner surface 22*a* of the front support member 22 is a ratchet member 23. The ratchet member 23, together with a pawl assembly to be described momentarily, helps to maintain the seating section 12** in a desired reclined position once the seat occupant urges the seating section past a predetermined point of rearward travel.

Further secured to the inner side walls **14*a* are a pair of rocker blocks 26. With brief reference to FIG. 4, each rocker block 26 includes a support surface 28 comprised of a generally curved portion 30 and a generally flat or planar portion 32 toward a rearmost end of the rocker block 26. A plurality of drilled holes 26*a*, 26*b* and 26*c* are precisely located to properly orientate the seating section 12 at the desired attitude. This will be discussed is greater detail in the following paragraphs. The rocker block 26** is typically constructed of a hardwood such as maple, oak, elm or hard maple.

Figure 5:
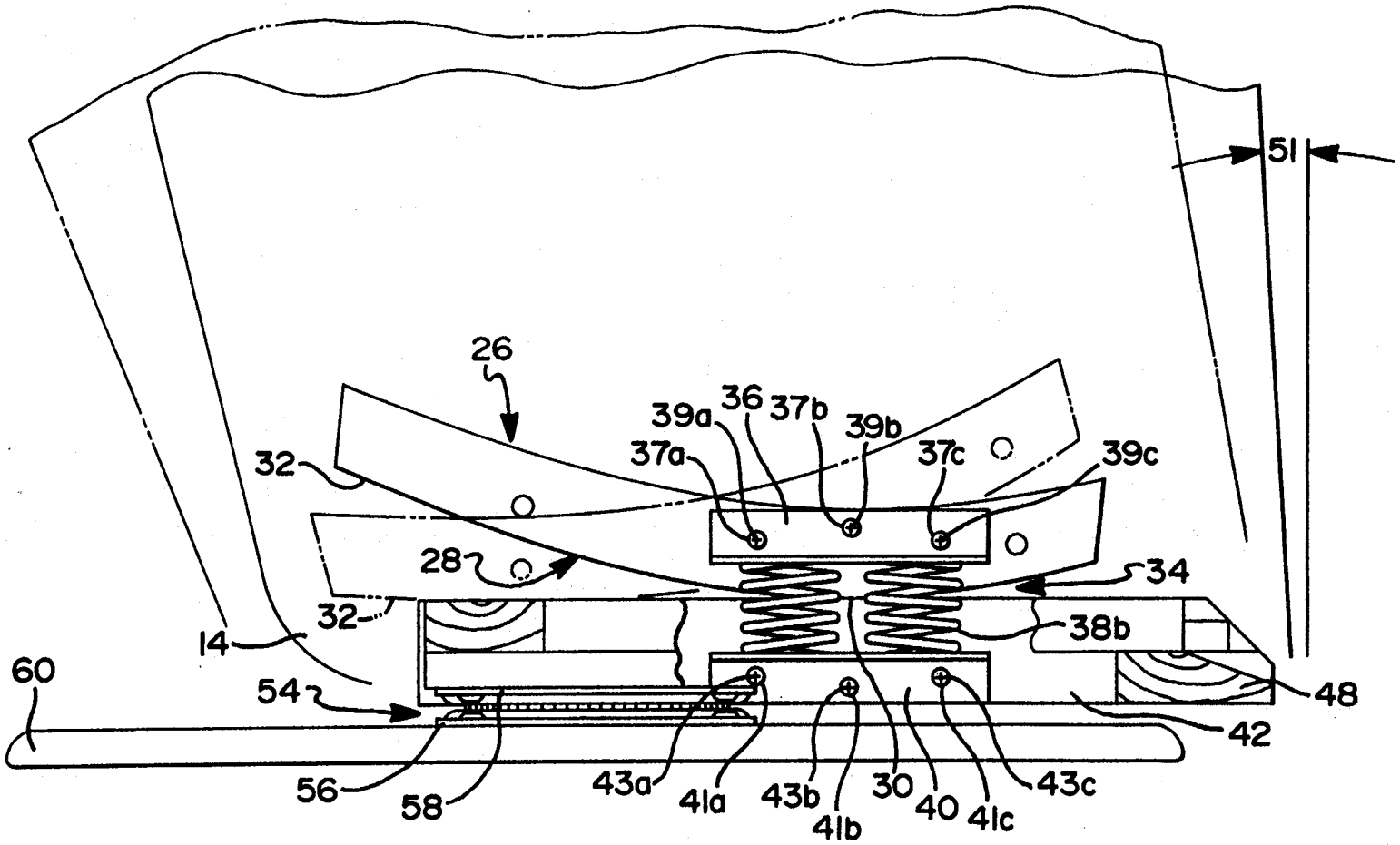
FIG. 5 is a side view of the chair of FIG. 1 showing the chair side wall coupled via the rocker block and spring assembly to the base assembly of the chair, and more particularly illustrating the orientation of the apertures in the upper and lower bracket members of the spring assembly and how the spring assembly is secured to the rocker block and base assembly to bias the chair into a slightly reclined position even when no occupant is present in the chair, and further how the flat portion of the rocker block positively limits the rearward rocking motion of the chair.

With further reference to FIGS. 2 and 5, secured to each of the rocker blocks 26 is a spring assembly 34 (only one being shown in FIG. 2). With brief reference to FIG. 5, each of the spring assemblies 34 include an upper bracket member 36, a pair of coil springs **38*a* and 38*b*, and a lower bracket member 40. The upper bracket member 36 of each spring assembly 34 includes a plurality of apertures 37*a*, 37*b* and 37*c* for allowing a corresponding plurality of suitable fasteners 39*a*, 39*b* and 39*c* to be used to couple the upper bracket member 36 fixedly to the holes 26*a*, 26*b* and 26*c*, respectively, of its associated rocker block 26. The spring assemblies 34** are also described in U.S. Pat. No. 5,171,000, assigned to the assignee of the present application, which is hereby incorporated by reference.

Figure 3:
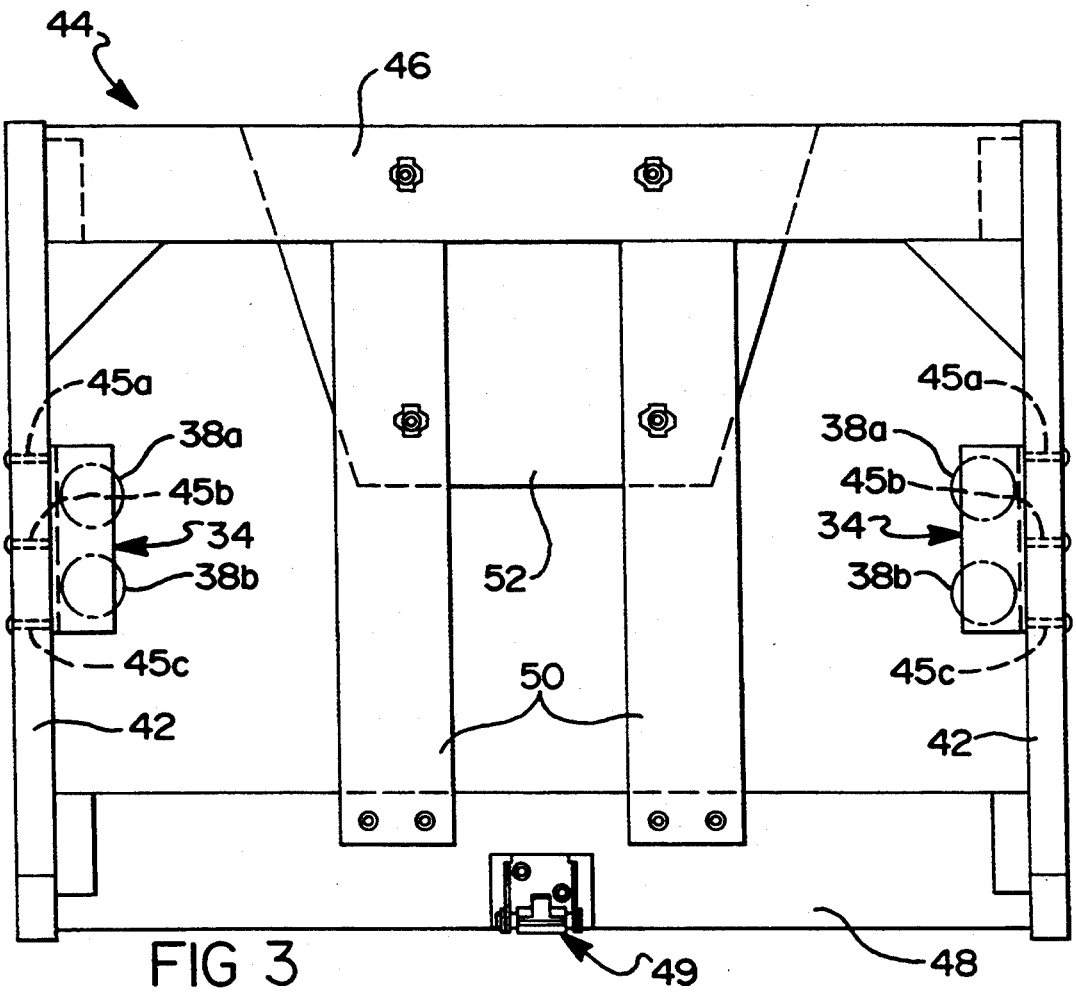
FIG. 3 is a top view of the base assembly shown in FIG. 2.

With further reference to FIGS. 2 and 3, the spring assemblies 34 are fixedly secured to a pair of side members 42 of a base assembly 44. The side members are secured apart from one another a desired width by a rear brace member 46 and a front brace member 48. A pair of inner support members 50 are also fixedly secured between the rear brace member 46 and the front brace member 48 to add even further structural rigidity to the base assembly 44. A swivel mounting member 52 is further secured to the rear support member 46 and inner support members 50.

The front brace member 48 has secured thereto a pawl assembly 49 which cooperates with the ratchet member 23 to maintain the chair 10 in a desired reclined position. The pawl assembly 49 and ratchet member 23 are the subject of U.S. application Ser. No. 07/826,691, filed Jan. 31, 1992, which is presently allowed, and which is assigned to the assignee of the present application, and hereby incorporated by reference.

With reference now to FIGS. 2 and 5, the base assembly 44 is supported for swiveling (i.e., rotational) movement via a swivel plate assembly 54 having an upper plate 56 which is fixedly secured to the swivel mounting member 52 of the base assembly 44. A lower plate 58 of the swivel plate assembly 54 is also fixedly secured to a swivel base member 60. The swivel plate assembly 54 thus permits the base assembly 44, and thus the seating section 12, to be swivelled about the base member 60. As particularly well shown in FIG. 5, the rocker block 26, and thus the entire seating section 12 is located off center forwardly of the geometric center of the swivel base member 60. This is so that rearward rocking or reclining motion of the seating section is less likely to cause an undesirable rearward rocking of the swivel base member 60.

With further reference to FIGS. 3 and 5, the lower bracket member 40 of the spring assembly 34 includes a plurality of apertures 41*a*, 41*b* and 41*c* for enabling a corresponding plurality of suitable fasteners 43*a*–43*c* to be used to secure the lower bracket member via blind holes 45*a*–45*c* (FIG. 3) to an associated one of the side members 42 of the base assembly 44. It is a principal object of the present invention that the bracket members 36 and 40 be secured to their respective rocker block 26 and side member 42 in a manner to cause the coil spring 38*a*, which is closest to a rear portion 42*a* of the side member 42, to exert a tensioning force which urges the side wall 14 of the chair 10, and thus the seat back 18 of the chair 10, into a slightly reclined position even when no occupant is seated in the chair 10. To accomplish this the positions of the holes 26*a*, 26*b* and 26*c* drilled in the rocker block 26 are such that the vertical distance between the hole 26*a* and the hole associated with the aperture 41*a* of the lower bracket member is greater than the vertical distance between the hole 26*c* and the hole associated with the aperture 41*c* of the lower bracket member 40. This results in a "pre-loading" of each spring assembly 34. By pre-loading it is meant that the tensioning force exerted by the spring 38*a* of each spring assembly 34 is slightly greater than that exerted by the springs 38*b*. Consequently, the rocker blocks 26, and thus the seating section 12, are urged into a slightly reclined position when no occupant is seated in the chair 10. The degree of recline may vary, but is preferably in the range of about 2°–10° and more preferably about 5°, as indicated by angle 51 in FIG. 5.

The pre-loading of each bracket assembly 34 which urges the chair 10 into the slightly reclined position serves to help prevent the seating section 12 from rocking too far forwardly when the individual is either rocking in the chair 10 or getting up out of the chair 10 as the chair 10 moves rapidly from a fully reclined position to an upright position. This, in turn, helps prevent the base assembly 44 from causing a rocking motion of the swivel base member 60 due to the base assembly 44 being positioned forwardly of the geometric center of the swivel base member 60.

With further reference to FIG. 5, the rocker block 26 on each side wall 14 further helps to limit the maximum rearward rocking or reclining movement of the chair section 12 relative to the base assembly 44 by the use of the generally flat portion 32. During normal rocking or reclining movement of the chair, the curved portion 30 of the support surface 28 rocks on the side member 42 of the base assembly 44. As the seating section 12 is urged into a reclined position relative to the base assembly 44, the generally flat portion 32 of the rocker block 26 comes into abutting contact with the side member 42, as shown in phantom in FIG. 5. When the entire flat portion 32 is resting against the side member 42, further reclining or rearward rocking action will be prevented. It will be appreciated, then, that the overall length of the rocker block 26, as well as the radius of curvature of the curved portion 30 and the length of the generally flat portion 32 are all important considerations which must be taken into account in determining to what degree to limit reclining or rearward rocking motion of the seating section 12. In the preferred embodiment the overall length of the rocker block 26 is preferably between about 13 and 14 inches, and more preferably about 13.25 inches. The radius of curvature of the curved portion 30 is preferably in the range of about 17–18 inches, and more preferably about 17.5 inches. The generally flat portion 32 preferably comprises the rearmost 25% to 33% of the total length of the rocker block 26.

It will be appreciated from the foregoing description that the chair 10 of the present invention experiences virtually no rocking of the swivel base member 60. Also, the maximum reclining or rearward rocking motion of the chair 10 is controllably limited without the need to incorporate additional components into the chair 10. Thus, the complexity of manufacture of the chair 10 is not increased. Moreover, the overall cost of the chair 10 is not increased significantly.

Referring now to FIG. 6, an alternative preferred base member 62 is illustrated. Base member 62 is particularly well adapted for non-swivel applications. Accordingly, the potential forward rocking of the base member 60 described herein is not a concern with the base assembly 62 as this assembly is adapted to rest directly on a floor or other like support surface.

Base assembly 62 includes a pair of side members 64 spaced apart a predetermined distance by a rear brace member 66 and a front brace member 68. The pawl assembly 49 is operably secured to the front brace member 68 for engagement with the ratchet member 23 shown in FIG. 2. The coupling of the side members 64 to the spring assemblies 34 shown in FIG. 2, and thus to the rocker blocks 26, is identical to that described herein in connection with FIG. 5. Accordingly, the side members 64 of the base assembly 62 operate cooperatively with the generally flat portions 32 of the rocker blocks 26 to limit the maximum reclining and rocking motion of the seating section 12.

The swivel recliner/rocker chair 10 of the present invention accomplishes even more secure supporting of the seating section relative to a swivel base member of the chair to eliminate any possible rocking movement of the swivel base member when the chair is rocked forwardly relative to the base member. The chair 10 of the present invention further provides a simple yet very effective means for limiting the maximum rearward rocking and reclining movement of a seating section of the chair relative to a base assembly.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A swivel rocker/recliner chair comprising:

a seating section having a pair of vertically disposed side walls;

a pair of rocker blocks fixedly secured to said side walls, each said rocker block having a support surface including a curved portion and a generally flat portion;

a base assembly;

a pair of spring assemblies adapted to be secured to said rocker blocks and said base assembly so as to secure said rocker blocks to said base assembly to thereby enable said seating section to rock on said base assembly;

a swivel base member;

a swivel plate assembly fixedly secured to said swivel base member and to said base assembly to allow rotational movement of said base assembly relative to said swivel base member;

each said spring assembly including:

an upper bracket member;

a lower bracket member;

at least a front spring and a rear spring disposed between said upper and lower bracket members;

said upper bracket member including a plurality of apertures and being adapted to be secured to one of said rocker blocks;

said lower bracket member including a plurality of apertures and being adapted to be secured to a portion of said base assembly, said apertures in said upper and lower bracket members of each said spring assembly being positioned so as to cause a pre-tensioning between said upper and lower bracket members at a rearward portion of each said spring assembly such that each said rear spring of said pair of spring assemblies exerts a greater tensioning force than each of said front springs of said pair of spring assemblies, to thereby bias said seating section into a slightly reclined orientation prior to said seating section being occupied by a seat occupant.

2. The swivel recliner/rocker chair of claim 1, further comprising a front cover operably secured to said side walls of said seating section;

a ratchet member secured to said front cover; and a pawl assembly secured to said base assembly for engaging with said ratchet member to maintain said seating section in a desired, reclined position.

3. The swivel recliner/rocker chair of claim 1, wherein each said rocker block is positioned on its associated said side wall such that said flat portion of each said rocker block contacts a portion of said base assembly at a predetermined point during rearward rocking and reclining motion to limit said rearward rocking and reclining motion of said seating section to a predetermined degree.

4. The swivel recliner/rocker chair of claim 1, wherein said base assembly is secured to said swivel plate assembly to position said base assembly, and therefore said seating section, off-center from a geometric center of said swivel base member.

5. A swivel recliner/rocker chair comprising:

a seating section having a pair of parallel disposed side walls, a seat back and a seat section;

a rocker block secured to an inner side portion of each of said side walls, said rocker blocks having a curved portion and a generally flat portion;

a base assembly;

a pair of spring assemblies for securing said seating to said base assembly for reclining movement relative to said base assembly, each said spring assembly including an upper bracket member, a lower bracket member, and a front spring and a rear spring secured therebetween, said upper bracket member of each said spring assembly being secured to a respective one of said rocker blocks and said lower bracket member of each said spring assembly being secured to a portion of said base assembly such that each said rear spring exerts a greater tensioning force than each said front spring, to thereby cause said rocker blocks, and thus said seating section, to be biased into a slightly reclined position relative to said base assembly when said chair is unoccupied, and wherein said flat portions of said rocker blocks operate to limit reclining movement of said seating section to a predetermined degree;

a swivel base member; and a swivel plate assembly for securing said base assembly to said swivel base member to permit rotational movement of said base assembly relative to said swivel base member.

6. The swivel recliner/rocker chair of claim 5, further comprising:

a front cover secured to said side walls;

a ratchet member secured to said front cover; and a pawl assembly operably coupled to said base assembly for engaging with said ratchet member to maintain said seating section in a desired reclined position as said seating section is urged into said desired, reclined position by an occupant thereof.

7. The swivel recliner/rocker chair of claim 5, wherein said base assembly is secured to said swivel plate assembly such that said base assembly is positioned off of a geometric center of said swivel base member, to thereby inhibit rocking of said swivel base member when said seating section is urged into a fully reclined position by an occupant.

8. A swivel recliner/rocker chair comprising:

a seating section having a pair of parallel disposed side walls, a seat back, and a seat member;

a rocker block securely affixed to an inner side portion of each of said side walls, each said rocker block including a support surface having curved portion and a generally flat portion;

a base assembly having a pair of side members spaced apart by a distance in accordance with a spacing of said rocker blocks, a rear support member and a front support member secured to said side members, and a swivel support member;

a pair of spring assemblies associated with said rocker blocks, each said spring assembly including an upper bracket member, a lower bracket member, a front coil spring and a rear coil spring, said upper bracket member of each said spring assembly being adapted to be fixedly secured to an associated one of said rocker blocks and said lower bracket member of each said spring assembly being adapted to be secured to an associated one of said side members of said base assembly such that said support surface of each said rocker block rests upon a portion of a respective one of said side members, and further such that said rear coil springs of each said spring assembly exert a tensioning force on a portion of said rocker block which is greater than the tensioning force exerted by said front coil springs, to thereby cause said rocker block, and thus said seating section, to be urged into a slightly reclined position relative to said base member prior to an occupant occupying said seating section;

a swivel plate assembly having an upper plate member and a lower plate member, said upper plate member being adapted to be fixedly secured to said swivel support member of said base assembly; and a swivel base member being secured to said lower plate member of said swivel plate assembly for disposing said base assembly for rotational movement relative to a floor supporting said swivel base member.

9. The swivel recliner/rocker chair of claim 8, further comprising:

a front cover secured between said side walls of said seating section;

a ratchet member secured to said front cover;

a pawl assembly operably secured to said front support member of said base assembly and engageable with said ratchet member to maintain said seating unit in a desired reclined position.

* * * * *